United States Patent [19]

Hegstad

[11] Patent Number: 5,023,428

[45] Date of Patent: Jun. 11, 1991

[54] SURFACE COATING

[76] Inventor: Björn Hegstad, Alf Godagers vei 16, 7081 Sjetnhaugan, Norway

[21] Appl. No.: 346,999

[22] Filed: May 3, 1989

[51] Int. Cl.[5] ..... H05B 3/00

[52] U.S. Cl. ..... 219/213; 219/540

[58] Field of Search ..... 219/540, 528, 213, 212

[56] References Cited

U.S. PATENT DOCUMENTS 3,454,746 7/1969 DuBois ..... 219/213

4,141,187 2/1987 Graves ..... 219/213

*Primary Examiner*—Roy N. Envall, Jr.

*Attorney, Agent, or Firm*—James E. Pittenger

[57] ABSTRACT

A surface coating with heater cable, for the heating of surface structures such as ships' decks, or floors. The coating consists of a foundation layer of a plastic material which forms a base for the heater cable (2), a conducting layer (4) of a plastic material where particles of metal or similar thermically-conducting particles (5) are sealed inside, and a covering layer (6) of a material with significantly lower thermic conductivity, than the conducting layer.

8 Claims, 1 Drawing Sheet

SURFACE COATING

The invention concerns a surface coating or composite layer for heating surfaces and similar structures such as ship decks, floors, and particularly areas where there is danger of icing. The coating is also designed for indoor surfaces which require heating such as floors.

Surface coatings exist which have heater cables covered by a plastic material which is polymerized in situ. The plastic material has metal particles sealed inside to help lead the heat towards the exposed surface.

Nevertheless, such coatings result in uneven surface heating, with local heating along the heater cable and lower temperatures in the areas between the cables.

The main objective of the present invention is to find a means of surface heating, particularly for outdoor applications, which maintains a more even temperature than any known surface coating, and which simultaneously provides the mechanical and other advantages of heater cables compared with heating elements made of foil or plates. Among the subsidiary objectives are being able to reduce the energy supply to the surface coating to a level which is sufficient to complete the task at hand, for example: de-icing an oil platform by the heat from the heater cable. Another objective is to find means for rapidly conducting the heat away from the cable so that the latter can have a smaller diameter.

The surface coating or composite to have adequate mechanical characteristics and should also be durable and easy to lay. As one application is for rehabilitating buildings with normal door still heights, a further objective has been to design a thin coating.

All of these objectives can be met by designing a surface coating in accordance with the present invention.

The present invention will firstly reduce the heat loss towards the inner side of the surface. Then it will rapidly conduct the heat from the heater cable without any local overheating of the exposed surface. The result will be temperature equalization which makes it possible to reduce the maximum surface temperature to the minimal temperature to maintain the required operating conditions. This naturally results in energy savings, which can be sizeable given large surface areas such as offshore platforms, drilling rigs and ships.

Figure 1:
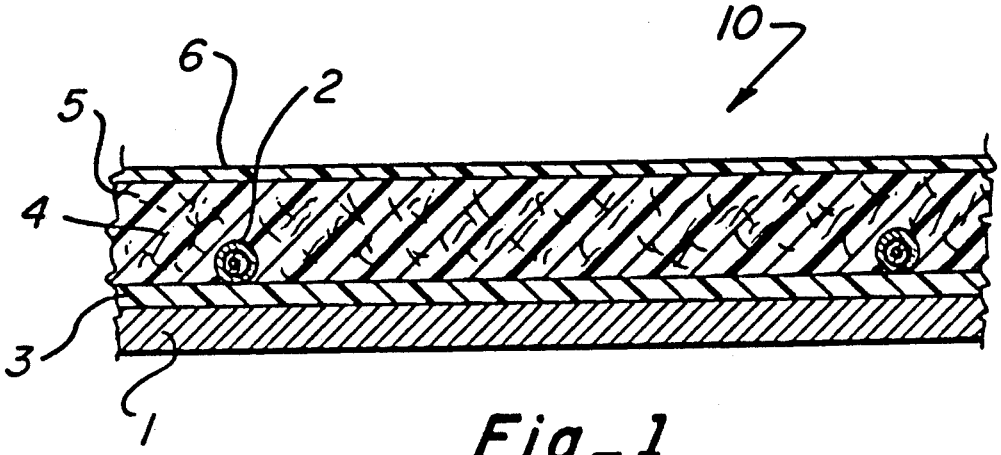
Figure 2:
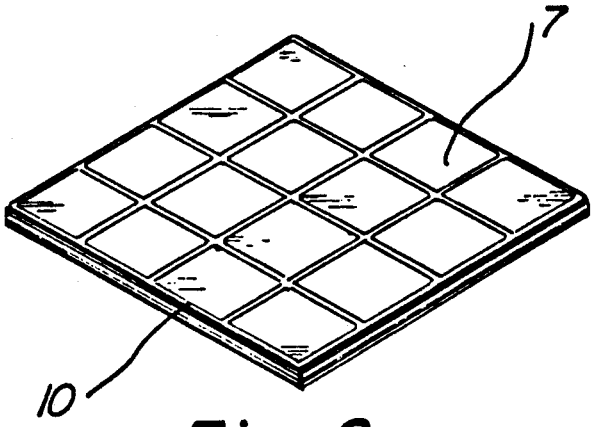
Figure 3:
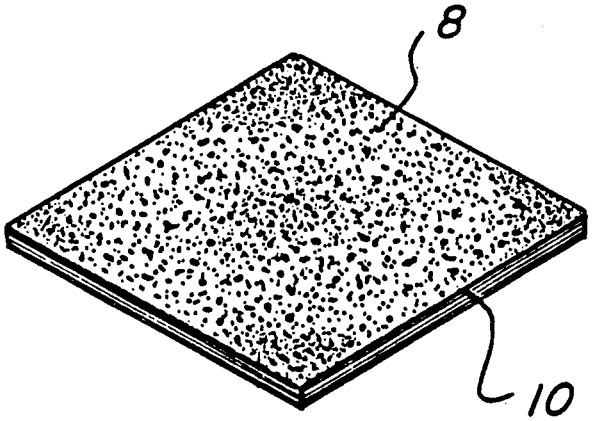

FIG. 1 of the drawings shows a section through a surface which has been covered by a coating or composite layer designed in accordance with the present invention.

FIG. two is perspective view showing ceramic tiles as the covering layer.

FIG. three is a perspective view showing quartz grains as the covering layer.

The under-surface or foundation layer 1 in the example is a steel plate, but this could also be made of other types of sheeting or materials such as chipboard, laminate, concrete or similar. An important functional specification for the surface coating 10, according to the present invention, is that it must reduce the heat transfer towards the under-surface 1, as this can mean a loss of heat and in the worst case lead to the overheating of sensitive components.

The under-surface is prepared for the laying of a heater cable 2 by applying an alkaline coating 3 of an electrically insulating substance that preferably has low thermic conductivity. An example of such could be a plastic material that is polymerized in situ. Some kind of reinforcement could also be incorporated into the plastic, such as a glassfibre matting. Another possibility is laying an alkaline coating 3 on a layer of thermically-insulating material such as a porous plastic plate.

An alternative to using to a heating cable is possible use of a string-like heating elements, such as ribbon heating foils.

The heating cable 2 may be of the conventional, known type, which is laid with suitable density for the particular application and cable power. The cable can be secured during polymerization by an adhesive or other appropriate means. The invention makes it possible to reduce the cable diameter by using less insulation than has been normal to date.

Above the heater cable 2 the first covering layer, or heat conducting layer 4 is composed of a plastic composite, such as an acrylic material. This layer contains bits or particles 5 of a material with high heat conductivity. Suitable materials for this purpose include steel swarf, or chips of other metals or ceramics. Though the content of such particles can exceed 10–40%, it will normally be around 5–10%.

A covering layer 6 of plastic is then laid on top of the conducting layer 4. The covering layer 6 does not have any metal swarf or thermically-conducting materials added. As this layer has the function of a heat equalization layer, it has considerably lower conductivity than the conducting layer 4, in quantative terms this will be between 20–60% less conductive. Layer 6 could have particles added to improve its durability, or it could have an outer covering layer on top (not illustrated) which could be of a durable material that could have different thermic characteristics than layer 6.

EXAMPLE

After degreasing the steel plates on a platform deck a foundation layer of an acrylic material was laid, this was between 2–4 mm thick. After this had hardened, a heater cable was laid on top and temporarily held in position by an adhesive. The heater cable was arranged so that it covered the deck at about 10 cm intervals. The cable was then covered by an acrylic mass mixed with steel swarf (25% of the mixture being steel swarf). This layer was about 15 mm thick. A further layer of 1–2 mm of acrylic plastic was then applied. Measurements showed that the temperature variation on the surface was about +0.1° C., when the cable output was 400 $W/m^2$.

In a second example, 1 liter of plastic mass "Silikal 1061 FR" was mixed together with 3 kg of quartz sand, 0.6 kg of aluminum pins and an accelerator, this was then used as the conducting layer 4. Then, a second layer composed of the same substances except the aluminum pins was laid in a 2–4 mm thick strata on top as the covering layer. This also resulted in a satisfactory surface coating.

There are a number of modifications that can be made within the framework of the invention. Though acrylic plastic has proved to be particularly suitable, other plastics that can be applied in a liquid state are also feasible.

The thermically-conducting particles can have a number of forms. These include fibres, chips or granular particles. They can be made of steel, aluminum or other metals, composites or ceramic materials with high thermal conductivity. The covering layer 6 can also be composed of ceramic tiles or quarts grains which provide the desired heat conducting characteristics.

The surface coating in accordance with the invention can be used for other purposes than heating exposed surfaces. These applications include tanks and supportive structures.

What is claimed is:

1. A surface coating with heater cable, for the even heating of surface structures such as ships' decks, particularly for the purpose of hindering icing, the coating comprises:

a heating means being evenly distributed across the area to be covered by the surface coating, a foundation layer of a plastic material which forms a base means for the heating means, a layer of a plastic material which covers the heating means and includes thermically-conducting particles embedded therein, a covering layer of a material having a lower thermic conductivity than said conducting layer containing the particles.

2. A surface coating in accordance with claim 1, wherein the covering layer has a finishing layer of a durable material.

3. A surface coating in accordance with claim 1, wherein the covering layer consists of a plastic material which is polymerized in place.

4. A surface coating in accordance with claim 1, wherein the covering layer consists of ceramic tiles.

5. A surface coating in accordance with claim 1 wherein said heating means is a heating cable.

6. A surface coating in accordance with claim 2 wherein the finishing layer is formed from quartz grain.

7. A surface coating in accordance with claim 3 wherein the plastic material making up the covering layer is an acrylic plastic.

8. A surface coating in accordance with claim 1 wherein the covering layer has a thermic conductivity which is approximately one-half of the conductivity of the layer of plastic material.

* * * * *